US006788255B2

(12) United States Patent
Sakamoto et al.

(10) Patent No.: US 6,788,255 B2
(45) Date of Patent: Sep. 7, 2004

(54) ANTENNA UNIT HAVING RADIO ABSORBING DEVICE

(75) Inventors: Koji Sakamoto, Nishio (JP); Shinji Fukui, Okazaki (JP); Shirou Koide, Anjo (JP); Akihiko Hayashi, Ogaki (JP); Kazunobu Noda, Nagoya (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 0 days.

(21) Appl. No.: 10/201,597

(22) Filed: Jul. 24, 2002

(65) Prior Publication Data

US 2003/0020657 A1 Jan. 30, 2003

(30) Foreign Application Priority Data

Jul. 25, 2001 (JP) ..... 2001-224743
Jul. 17, 2002 (JP) ..... 2002-208191

(51) Int. Cl.[7] ..... H01Q 1/38
(52) U.S. Cl. ..... 343/700 MS; 343/713; 343/846
(58) Field of Search ..... 343/700 MS, 711, 343/713, 845, 846, 848

(56) References Cited

U.S. PATENT DOCUMENTS 5,589,842 A * 12/1996 Wang et al. ..... 343/787
6,100,855 A * 8/2000 Vinson et al. ..... 343/846
6,144,343 A * 11/2000 Furuya et al. ..... 343/713

FOREIGN PATENT DOCUMENTS

| | | |
|---|---|---|
| JP | U-5-23610 | 3/1993 |
| JP | U-7-25609 | 5/1995 |
| JP | A-9-46129 | 2/1997 |
| JP | A-11-330847 | 11/1999 |
| JP | A-2000-77930 | 3/2000 |

* cited by examiner

*Primary Examiner*—Don Wong
*Assistant Examiner*—Shih-Chao Chen
(74) *Attorney, Agent, or Firm*—Posz & Bethards, PLC

(57) ABSTRACT

An antenna unit includes a substrate having an antenna device and a radio absorbing device. The antenna device, substrate and radio absorbing device are constructed of a patch device, a conductive material and ferrite, respectively. The radio absorbing device is attached to the rear surface of the substrate. The radio absorbing device reduces incoming radio wave signals to travel to the rear surface of the substrate due to reflections by surrounding metal parts.

27 Claims, 6 Drawing Sheets

ANTENNA UNIT HAVING RADIO ABSORBING DEVICE

CROSS REFERENCE TO RELATED APPLICATION

This application is based on and incorporates herein by reference Japanese Patent Applications No. 2001-224743 filed on Jul. 25, 2001 and No. 2002-208191 filed on Jul. 17, 2002.

FIELD OF THE INVENTION

The present invention relates to an antenna unit having an antenna device mounted on a substrate made of a conductive material and particularly to an antenna unit, which has less distortion in its directivity due to secondary radio wave signals radiated from the substrate.

BACKGROUND OF THE INVENTION

In recent years, progress has been made in downsizing antenna units. This makes possible to install a global positioning system (GPS) antenna unit for a GPS navigation system in a dashboard of a vehicle.

When the GPS antenna unit is installed in a vehicle, it receives radio wave signals from satellites through a front windshield. The radio wave signals are reflected between the substrate of the GPS antenna unit and the front windshield. As a result, levels of the received signals vary depending on the position of the GPS antenna unit. To solve this problem, a device having a radio absorbing material on the top surface side of the substrate is proposed as disclosed in JP-A-11-330847.

However, when the GPS antenna unit is installed in a dashboard, directivity distortion occurs in some cases even though the radio absorbing material is installed. In such cases, the radio wave signals from the GPS satellites cannot be received. This results from many dielectrics and metal parts installed inside the dashboard. The radio wave signals are reflected off metal parts installed on the rear surface side of the antenna unit. As a result, the radio wave signals are radiated or diffracted from the rear surface side of the substrate to the top surface side, creating directivity distortion.

In a small antenna unit for a transmitting device such as an electronic toll collection (ETC) system, directivity distortion may occur as well. In such a unit, a substrate used as a ground is reduced in size and hence not sufficient for grounding. Therefore, the radiated radio wave signals are diffracted to the rear surface side of the substrate. The diffracted radio wave signals are reflected off surrounding parts and radiated as secondary radio wave signals from the surrounding parts, resulting in directivity distortion.

Even the method disclosed in JP-A-11-330847 is applied and a radio absorbing device is installed around the antenna device on the top surface side, this problem cannot be resolved.

SUMMARY OF THE INVENTION

The present invention therefore has an objective to provide an antenna unit that reduces distortion in directivity of the antenna caused by secondary radio wave signal radiation or diffraction.

An antenna unit of the present invention has a radio absorbing device on the rear surface side of a substrate. With this configuration, radiation of radio wave signals from the rear surface side can be reduced even when dielectrics or metal parts are installed around the antenna device. As a result, directivity distortion of the antenna due to interference with radiated radio wave signals from the dielectrics or metal parts can be effectively reduced.

The radio absorbing device is mounted in an area that tends to create an intense electrical field. Secondary radio wave signals tend to be radiated or diffracted from such an area including a corner or an edge of the substrate. Mounting the radio absorbing device only in the area can reduce directivity distortion at low cost.

A radio absorbing material can be used for the radio absorbing device. When the radio absorbing material is used, it can be provided on an entire rear surface of the substrate. This ensures reduction of secondary radio wave signal radiation from the substrate.

BRIEF DESCRIPTION OF THE DRAWINGS

The above and other objectives, features and advantages of the present invention will become more apparent from the following detailed description made with reference to the accompanying drawings. In the drawings.

DETAILED DESCRIPTION OF THE PREFERRED EMBODIMENT

Figure 1:
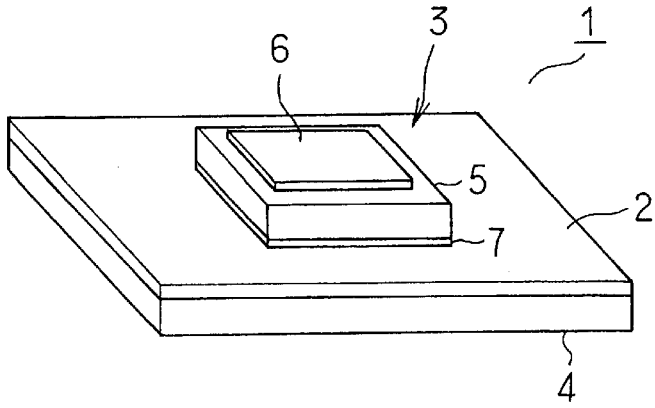
FIG. 1 is a perspective view of a GPS antenna unit according to the first embodiment of the present invention.

The preferred embodiments of the present invention will be explained with reference to the accompanying drawings.

In the drawings, the identical components are marked with the identical reference numerals.

First Embodiment

Referring to FIG. 1, a GPS antenna unit 1 includes a rectangular substrate 2 made of a conductive material such as copper, an antenna device 3 and a radio absorbing device 4. The antenna device 3 and radio absorbing device 4 are mounted on the top surface and rear surface of the substrate 2, respectively.

Figure 2:
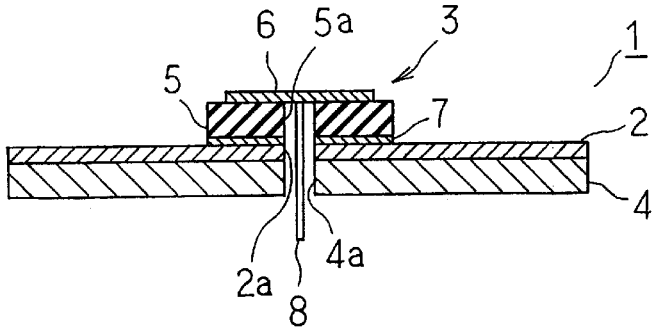
FIG. 2 a cross-sectional view of the GPS antenna unit according to the first embodiment of the present invention.

The antenna device 3 is constructed of a patch device. As in FIG. 2, a ceramic dielectric 5 has a conductor layer 6 on its front (top) surface and a ground electrode layer 7 on its rear (bottom) surface. The dielectric 5 has a lead-out hole 5*a*. One end of a power supply line 8 is connected to the conductor layer 6 and the other end is drawn out to the bottom surface side of the dielectric 5 through the lead-out hole 5*a*. The antenna device 3 is mounted on the substrate 2 as it maintains contact with the ground electrode layer 7. The substrate 2 and radio absorbing device 4 have through-holes 2*a* and 4*a*, respectively. The power supply line 8 is drawn out to the bottom surface of the substrate 2 through the holes 2*a* and 4*a*. The power supply line 8 is connected to a receiver circuit (not shown).

The radio absorbing device 4 is constructed of a radio absorbing material including a magnetic material such as ferrite and relatively in the same size as the substrate 2. It covers the entire bottom surface of the substrate 2. The material of the radio absorbing device 4 is not limited to ferrite. The radio absorbing device 4 can be a conductive material with a material that causes dissipation loss mixed or applied. The conductive material includes rubber and the material that causes dissipation loss includes graphite powder. The radio absorbing device 4 can be in the form that the material providing dissipation loss is applied to the bottom surface of the substrate 2.

Figure 3:
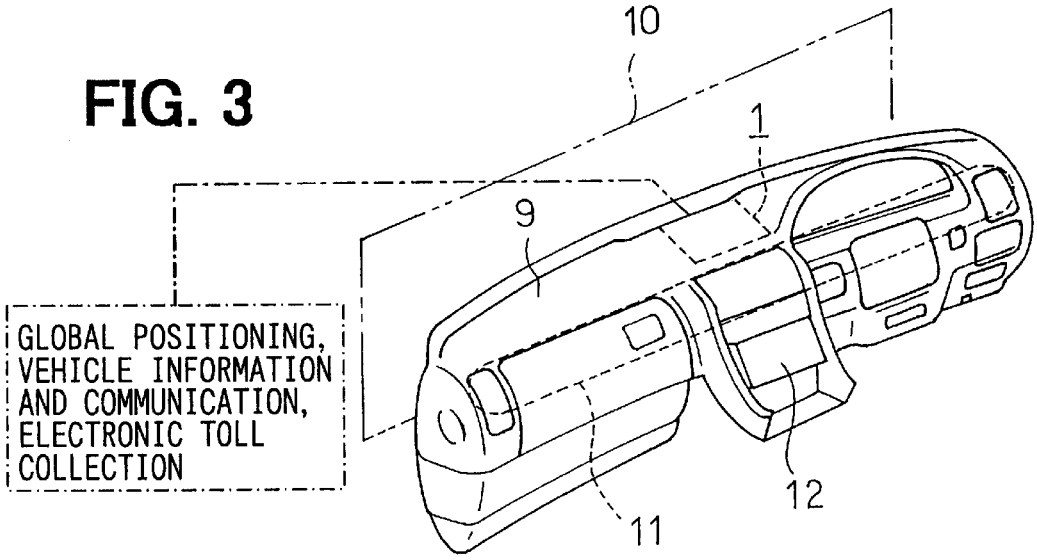
FIG. 3 is a perspective view of the GPS antenna unit installed in a dashboard according to the first embodiment of the present invention.

Referring to FIG. 3, the GPS antenna unit 1 is attached to the upper interior surface of a dashboard 9 and secured with mounting screws (not shown). The dashboard 9 is installed in front of a metal firewall 10 that divides an interior space of the vehicle and an engine compartment. In the dashboard 9, a lean hose 11 and an audio device 12 are housed. The lean hose 11 is used for increasing the rigidity of the vehicle or hanging an air conditioner.

In the GPS antenna unit 1, radio wave signals transmitted from a GPS satellite are received by the antenna device 3 and transmitted to the receiver circuit. The signals reflected off surrounding parts including the firewall 10, the lean hose 11 and a metal case of the audio device 12. Then, the signals travel to the bottom side of the GPS antenna unit 1 and to the bottom surface of the substrate 2.

If the radio absorbing device 4 is not attached, the signal reflected off the surrounding parts travels to the bottom surface of the substrate 2. As a result, current flows through the bottom surface and electric fields become intense around edges and corners of the substrate 2. From the intense electric fields, the signal is radiated or diffracted. However, the radio absorbing device 4 is attached to the entire bottom surface in this embodiment. Therefore, the signal reflected off the surrounding parts is absorbed by the radio absorbing device 4 and no signal is radiated from the substrate 2. As a result, directivity distortion due to the signal radiated from the substrate 2 and diffracted to the top side of the GPS antenna unit 1 can be reduced.

Figure 4A:
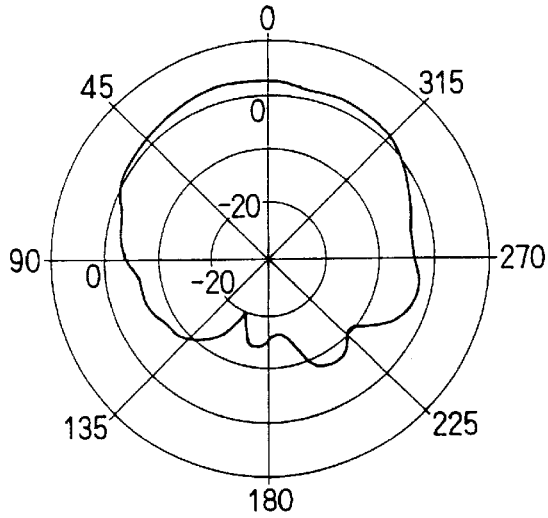
FIG. 4A is a characteristic diagram showing the directional characteristic of the GPS antenna unit in normal condition.
Figure 4B:
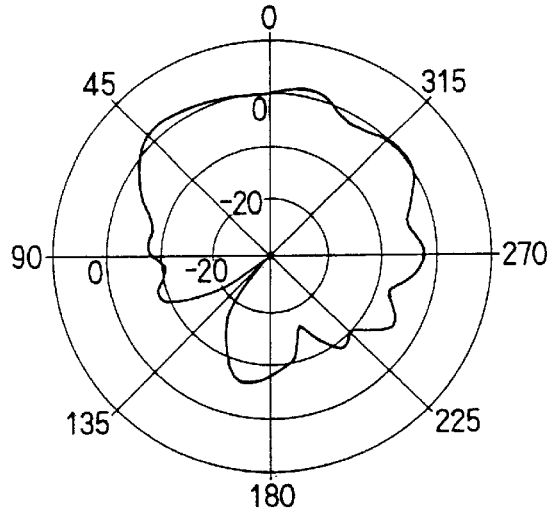
FIG. 4B is a characteristic diagram showing the directional characteristic of the GPS antenna unit in the case of interference.
Figure 4C:
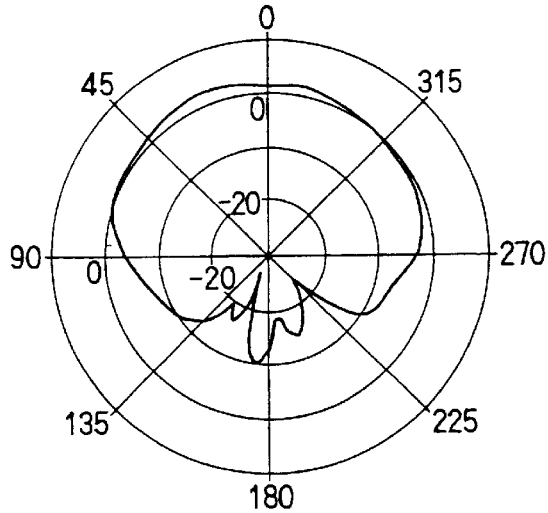
FIG. 4C is a characteristic diagram showing the directional characteristic of the GPS antenna unit with a radio absorbing device mounted on the rear side.

The antenna unit 1 shows directional characteristic as shown in FIGS. 4A to 4C when a metal member that imitates a condition inside the dashboard 9 is brought closer. When the radio absorbing device 4 is not attached, the signal from the substrate 2 is diffracted to the top surface side. This causes interference between the signal from the substrate 2 and the signal transmitted to the antenna device 3. As a result, directivity of the antenna unit 1 is distorted as shown in FIG. 4B. The distortion shown in FIG. 4B is more apparent than that in FIG. 4A, which shows the directional characteristic of the antenna unit 1 in normal condition.

When the radio absorbing device 4 is attached, the signals reflected off the surrounding parts are absorbed by the radio absorbing device 4. Therefore, signals are not radiated from the substrate 2 nor diffracted to the top side of the antenna unit 1. In this case, the antenna unit 1 shows directional characteristic as shown in FIG. 4C. The directivity distortion is corrected and the directivity is improved. In FIGS. 4A to 4C, the 0–180 line and 90–270 line indicate a plumb line and a horizontal line, respectively.

Although the radio absorbing device 4 is relatively in the same size as the substrate 2 in this embodiment, it can be larger than the substrate 2.

Second Embodiment

Figure 5:
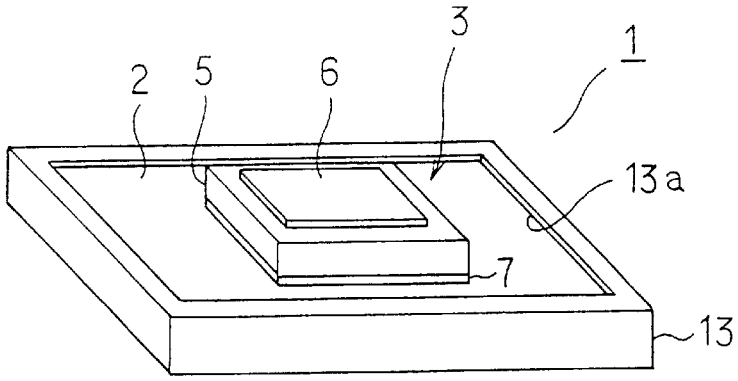
FIG. 5 is a perspective view of a GPS antenna according to the second embodiment of the present invention.

Referring to FIG. 5, a radio absorbing device 13 is sized larger than the substrate 2. A top surface of the radio absorbing device 13 has a recessed area 13*a*. The substrate 2 is fitted into the recessed area 13*a*. Making the radio absorbing device 13 to be larger than the substrate 2 ensures reduction of reflected radio wave signals off the surrounding parts traveling to the bottom surface. The substrate 2 is not necessary to be fit in the recessed area 13*a*. It can be simply placed on the radio absorbing device 13.

Figure 13:
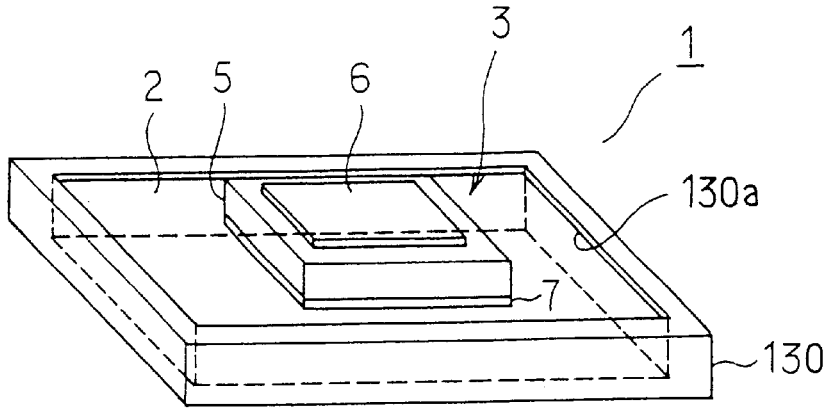
FIG. 13 is a perspective view of a GPS antenna unit according to a modification of the second embodiment of the present invention.

The radio absorbing device 13 can be modified as shown in FIG. 13. The radio absorbing device 130 is constructed so that the area covering the substrate 2 is hollowed out. This hollowed part is indicated with a numeral 130*a* in FIG. 13. This reduces a total amount of the radio absorbing material. Therefore, the radio absorbing device 130 has a cost advantage over the radio absorbing device 13.

Third Embodiment

Figure 6:
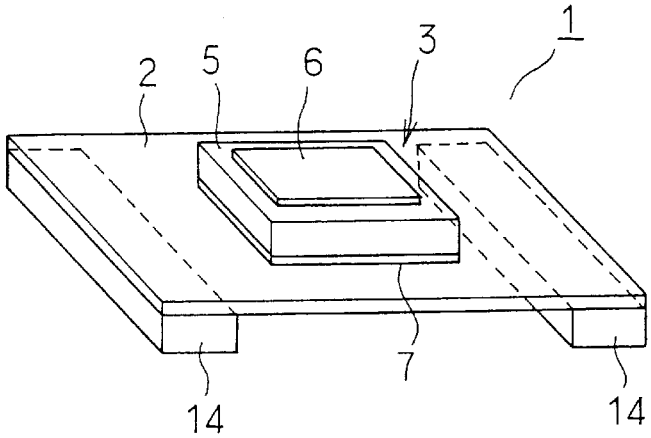
FIG. 6 is a perspective view of a GPS antenna according to the third embodiment of the present invention.

Referring to FIG. 6, radio absorbing devices 14 are attached along the edges of the substrate 2. Electric fields become intense around the edges when radio wave signals travel to the bottom surface. The radio absorbing devices 14 are attached so that the signals radiated or diffracted from the substrate 2 are reduced.

Figure 7:
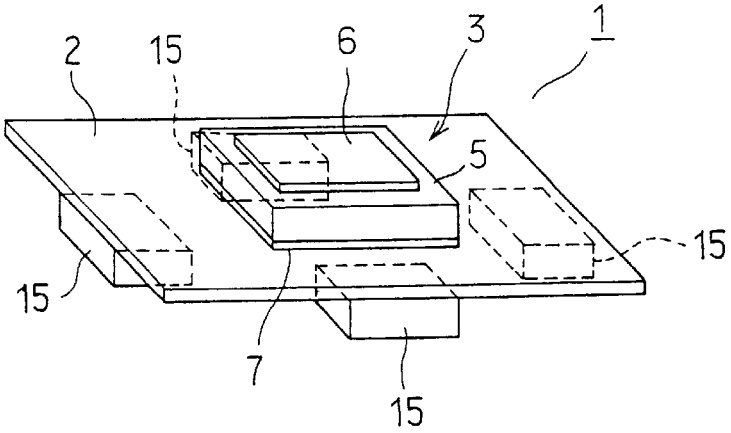
FIG. 7 is a perspective view of a GPS antenna according to a modification of the third embodiment of the present invention.

Each radio absorbing device 14 is reduced in size and attached along each side of the substrate as shown in FIG. 7. Utilizing the radio absorbing devices 15 can provide the same effect as the devices 14 at lower cost.

Figure 14:
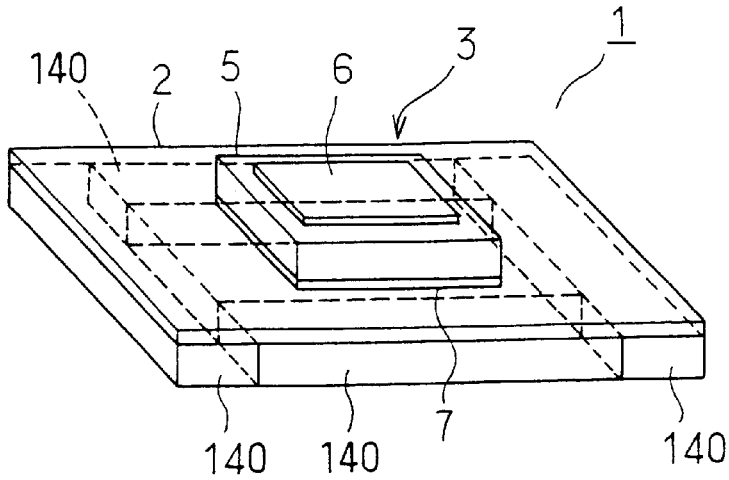
FIG. 14 is a perspective view of a GPS antenna unit according to a modification of the third embodiment of the present invention.

The radio absorbing devices 14 can be modified as shown in FIG. 14. The radio absorbing device 140 are attached along all edges of the substrate 2. The radio absorbing device 140 can be modified so that it attached along three edges of the substrate 2. Although minimum requirement for reducing the signals radiate or diffracted from the substrate 2 is attaching the radio absorbing device along one edge of the substrate 2. However the radio absorbing device 140 provides better effect in reducing the signals.

Fourth Embodiment

Figure 8:
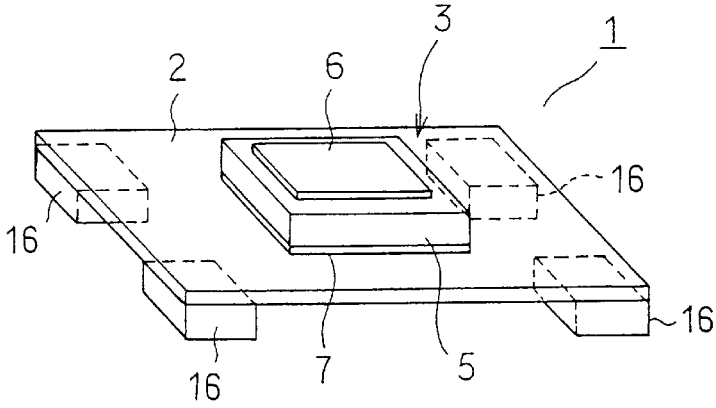
FIG. 8 is a perspective view of a GPS antenna according to the fourth embodiment of the present invention.

Referring to FIG. 8, radio absorbing devices 16 are attached in the corners of the substrate 2. Electric fields become intense around the corners when radio wave signals travel to the bottom surface. The radio absorbing devices 16 are attached so that the signals radiated or diffracted from the substrate 2 are reduced.

Fifth Embodiment

Figure 9:
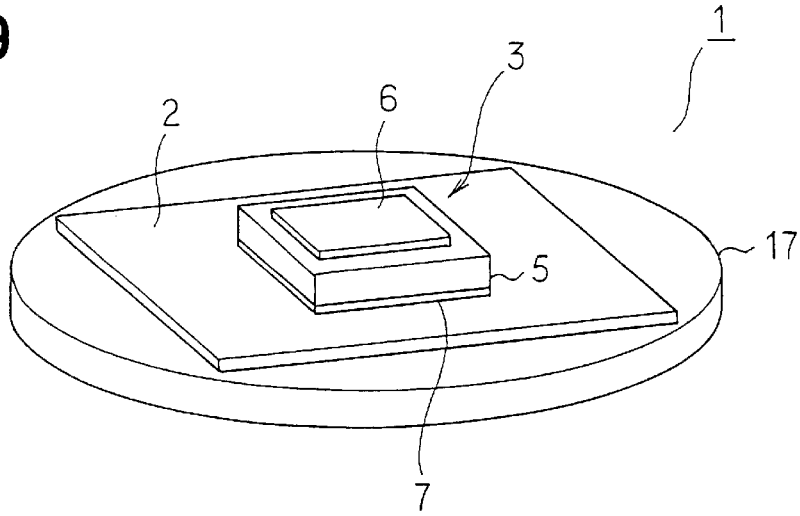
FIG. 9 is a perspective view of a GPS antenna according to the fifth embodiments of the present invention.

Referring to FIG. 9, a radio absorbing device 17 is attached covering the entire bottom surface of the substrate 2. The radio absorbing device 17 is attached so that the signals radiated or diffracted from the substrate 2 are reduced. The radio absorbing device 17 is circular or oval in shape.

Sixth Embodiment

Figure 10:
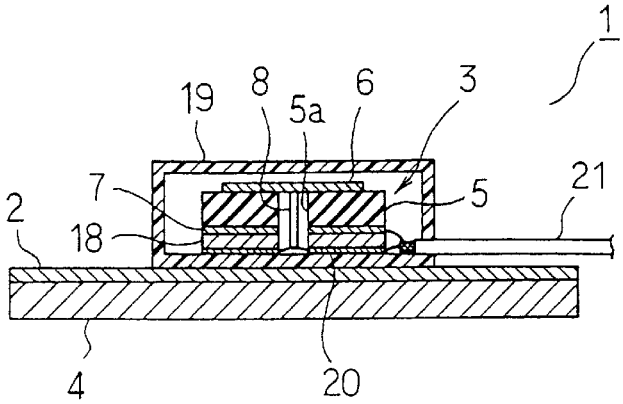
FIG. 10 is a cross-sectional view of a GPS antenna according to the sixth embodiment of the present invention.

Referring to FIG. 10, the antenna device 3 is mounted on a patch board 18 on which electronic components included in the receiver circuit are mounted. The antenna device 3 and patch board 18 are housed in a plastic case 19. The case 19 is mounted on the top surface side of the substrate 2. The radio absorbing device 4 is attached to the bottom surface side of the substrate 2. The power supply line 8 is connected to a microstrip line 20 that is formed on the bottom surface of the patch board 18. A coaxial cable 21 is connected to the microstrip line 20 and ground electrode layer 7.

Seventh Embodiment

Figure 11:
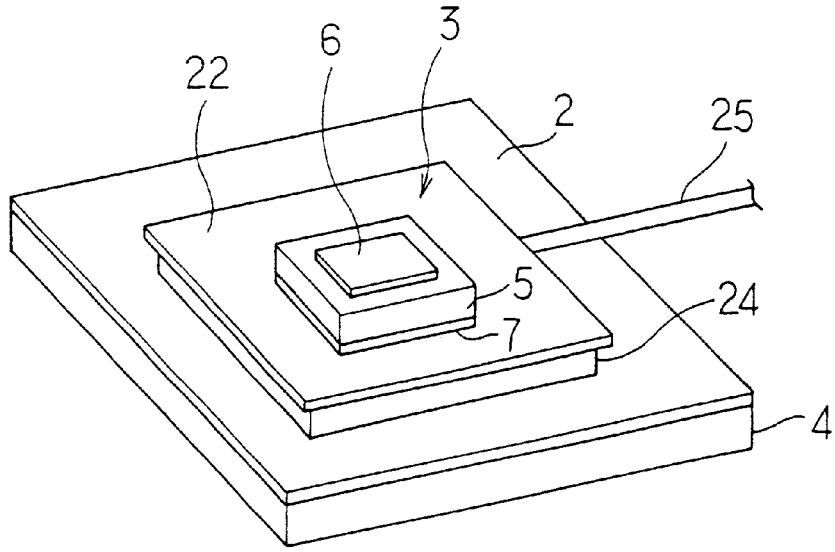
FIG. 11 is a perspective view of a GPS antenna according to the seventh embodiment of the present invention.
Figure 12:
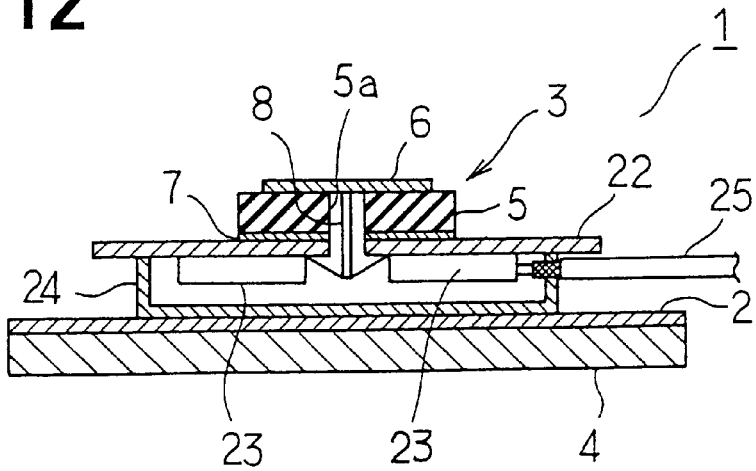
FIG. 12 is a cross-sectional view of the GPS antenna unit according to the seventh embodiment of the present invention.

Referring to FIGS. 11 and 12, the antenna device 3 is mounted on a patch board 22 and electronic components 23 included in the receiver circuit are attached to the bottom surface of the patch board 22. A shield case 24 is attached to the bottom surface of the patch board 22 to cover the electronic components 23 and mounted on the substrate 2. The radio absorbing device 4 is attached to the bottom surface of the substrate 2. The power supply line 8 is connected to the receiver circuit to which a coaxial cable 25 is connected.

The ground electrode layer 7 is grounded via an electric conductive path formed in the patch board 22. As a result, the substrate 2 functions as a mounting member to which the antenna unit 1 is mounted. Another possibility is to configure the substrate 2 so that the ground electrode layer 7 is connected to a ground.

The radio absorbing devices 4, 13, 14, 15, 16, 17, 130 and 140 in the above embodiments may be attached to the substrate 2 with adhesive such as double-faced tapes and glues.

The present invention should not be limited to the embodiment previously discussed and shown in the figures, but may be implemented in various ways without departing from the spirit of the invention.

The antenna unit is not limited to the GPS antenna unit 1. It can be antennas used for a vehicle information and communication system (VICS) or the ETC system. The antenna device is not limited to a patch device. It can be any type including an inverted-F antenna as long as it is installable on a substrate made of electric conductive materials. The radio absorbing devices 4 can be attached to both sides of the substrate 2.

What is claimed is:

1. An antenna unit comprising:

a substrate made of conductive material;

an antenna device mounted on one side of the substrate, wherein the antenna device has a ground electrode layer in contact with the one side of the substrate; and a radio absorbing device attached to another side of the substrate that is opposite to the one side, wherein the substrate is larger than the antenna device.

2. The antenna unit as in claim 1, wherein the radio absorbing device is attached to at least one of a plurality of corners of the substrate.

3. The antenna unit as in claim 1, wherein the radio absorbing device is attached along at least one of edges of the substrate.

4. The antenna unit as in claim 1, wherein the radio absorbing device is attached along all edges of the substrate.

5. The antenna unit as in claim 1, wherein the radio absorbing device is constructed of radio absorbing materials.

6. The antenna unit as in claim 1, wherein the radio absorbing device is a radio absorbing material covering an entire surface of the substrate.

7. The antenna unit as in claim 1, wherein the antenna unit is installed in a vehicle.

8. The antenna unit as in claim 1, wherein the antenna unit is installed inside a dashboard of a vehicle.

9. The antenna unit as in claim 1, wherein the antenna unit is any one of a global positioning system antenna, an antenna for a vehicle information and communication system and an antenna for the electronic toll collection system.

10. The antenna unit as in claim 1, wherein the radio absorbing device covers an entire surface of the another side of the substrate other than the side on which the ground electrode is mounted.

11. The antenna unit as in claim 1, wherein the substrate is a single-plated substrate.

12. The antenna unit as in claim 11, wherein the radio absorbing device is attached to at least one of the corners of the substrate.

13. The antenna unit as in claim 11, wherein the radio absorbing device is attached along at least one of a plurality of edges of the substrate.

14. The antenna unit as in claim 11, wherein the radio absorbing device is attached along all edges of the substrate.

15. The antenna unit as in claim 11, wherein the radio absorbing device is constructed of radio absorbing materials.

16. The antenna unit as in claim 11, wherein the radio absorbing device is a radio absorbing material covering an entire surface of the substrate.

17. The antenna unit as in claim 11, wherein the antenna unit is installed in a vehicle.

18. The antenna unit as in claim 11, wherein the antenna unit is installed inside a dashboard of a vehicle.

19. The antenna unit as in claim 11, wherein the antenna unit is any one of a global positioning system antenna, an antenna for a vehicle information and communication system and an antenna for the electronic toll collection system.

20. The antenna unit as in claim 1, wherein the radio absorbing device is made of a magnetic material.

21. An antenna unit comprising:

a substrate made of conductive material;

an antenna device mounted on one side of the substrate; and a radio absorbing device attached to another side of the substrate only along an edge thereof.

22. The antenna unit as in claim 21, wherein the radio absorbing device is attached to at least one of a plurality of corners of the substrate.

23. The antenna unit as in claim 21, wherein the radio absorbing device is attached along all edges of the substrate.

24. The antenna unit as in claim 21, wherein the radio absorbing device is constructed of radio absorbing materials.

25. The antenna unit as in claim 21, wherein the antenna unit is installed in a vehicle.

26. The antenna unit as in claim 21, wherein the antenna unit is installed inside a dashboard of a vehicle.

27. The antenna unit as in claim 21, wherein the antenna unit is any one of a global positioning system antenna, an antenna for a vehicle information and communication system and an antenna for the electronic toll collection system.

* * * * *